US005842965A

United States Patent [19]

Köhn et al.

[11] Patent Number: 5,842,965

[45] Date of Patent: Dec. 1, 1998

[54] LABORATORY CENTRIFUGE HAVING A SIMPLIFIED DESIGN

[75] Inventors: Heinz-Gerhard Köhn, Dransfeld; Rüdiger Uhlendorf, Niemetal, both of Germany

[73] Assignee: Heraeus Instruments GmbH & Co. KG, Hanau, Germany

[21] Appl. No.: 749,313

[22] Filed: Nov. 14, 1996

[30] Foreign Application Priority Data

Nov. 18, 1995 [DE] Germany ..... 195 43 088.3

[51] Int. Cl.[6] ..... B04B 7/02

[52] U.S. Cl. ..... 494/60; 494/14

[58] Field of Search ..... 494/14, 16, 20, 494/33, 60, 61, 83, 84, 85

[56] References Cited

U.S. PATENT DOCUMENTS

| | | | |
|---|---|---|---|
| 2,783,938 | 3/1957 | Grela et al. | 494/14 |
| 3,240,425 | 3/1966 | Ray et al. | 494/60 X |
| 3,244,363 | 4/1966 | Hein | 494/16 X |
| 4,193,536 | 3/1980 | Kubota . | |
| 4,226,669 | 10/1980 | Vilardi | 494/16 X |
| 4,693,702 | 9/1987 | Carson et al. | 494/61 |
| 4,764,162 | 8/1988 | Romanauskas | 494/61 X |
| 4,767,396 | 8/1988 | Powers | 494/60 |
| 5,242,370 | 9/1993 | Silver et al. | 494/60 X |

FOREIGN PATENT DOCUMENTS

| | | | |
|---|---|---|---|
| 72172 | 2/1951 | Denmark | 494/60 |
| 1256550 | 2/1961 | France | 494/60 |
| 832426 | 2/1952 | Germany | 494/60 |
| 859126 | 12/1952 | Germany | 494/60 |
| 950269 | 10/1956 | Germany | 494/60 |
| 4014439 C1 | 7/1991 | Germany . | |
| 123477 | 11/1948 | Sweden | 494/60 |
| 460433 | 1/1937 | United Kingdom . | |

*Primary Examiner*—Charles E. Cooley
*Attorney, Agent, or Firm*—Workman, Nydegger, & Seeley

[57] ABSTRACT

A laboratory centrifuge is known with a centrifuge housing which contains a motor and a rotor connected with the motor through a drive shaft, the motor being held in the motor housing which includes an upper end shield and a lower end shield, and with the motor having a rotor tank arranged above it which has a passage for the drive shaft on the motor side. In order to indicate, starting from here, a laboratory centrifuge which is economical to manufacture and simple to assemble, which can be cooled easily, if necessary, it is proposed that the rotor tank and the upper end shield be made as a single piece.

15 Claims, 1 Drawing Sheet

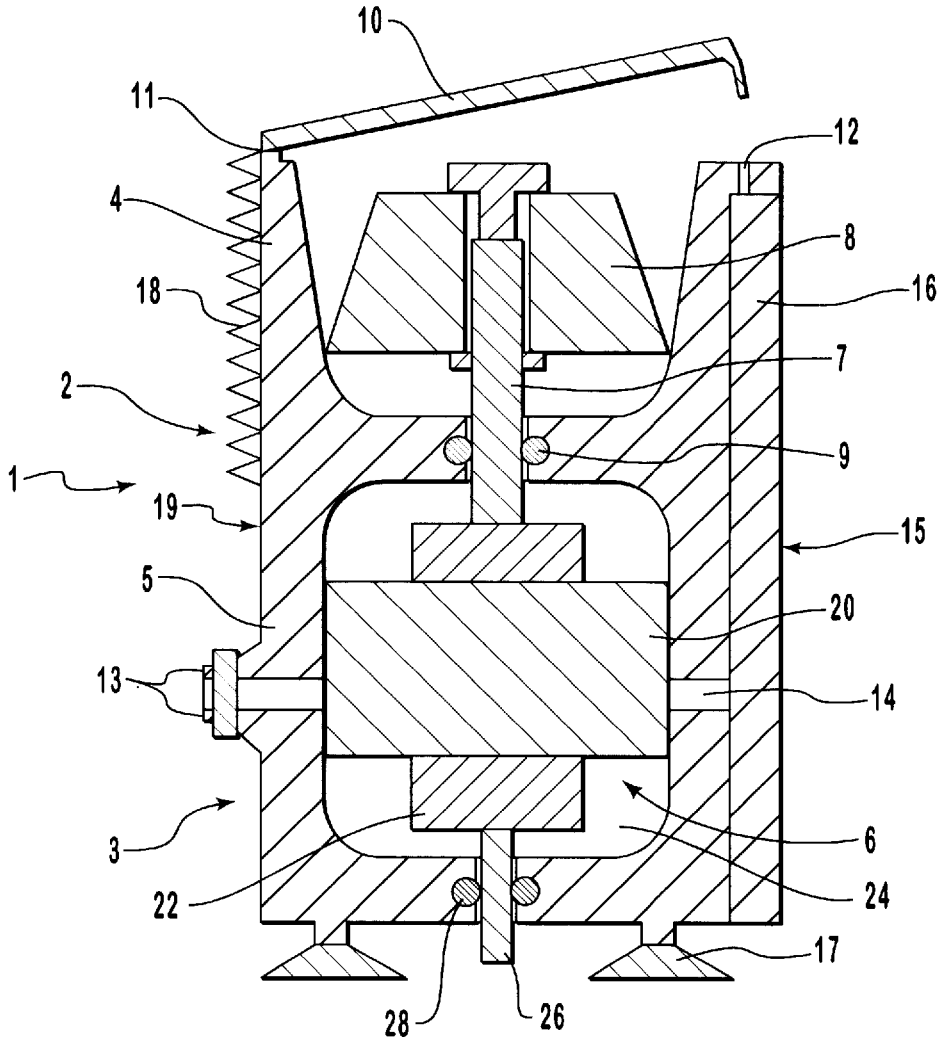
10
11
12
4
8
18
16
7
2
9
1
19
15
5
20
13
14
3
6
22
24
17
28
26

LABORATORY CENTRIFUGE HAVING A SIMPLIFIED DESIGN

BACKGROUND OF THE INVENTION

1. The Field of the Invention

The present invention concerns a laboratory centrifuge which is economical and easy to assemble and can be easily cooled.

2. Related Applications

Foreign priority benefits under Section 119 of Title 35 of the United States Code of German Utility Model Application No. 195 43 088.3, filed Nov. 18, 1995, incorporated herein by reference, are claimed for this application.

The Relevant Technology

The invention concerns a laboratory centrifuge, which contains a motor connected by a drive shaft to a rotor, the rotor being positioned within a rotor tank and the rotor tank being positioned above the motor and having a passage therethrough for the vertically-oriented drive shaft. The motor is held in a motor housing which includes an upper end shield positioned between the motor and the rotor tank and a lower end shield beneath the opposite end of the motor.

Such a laboratory centrifuge is known from German Utility Patent Application DE-C1 40 14 439. The centrifuge described there has a motor arranged inside its housing whose drive shaft is vertically oriented and is connected with a rotor. The rotor itself is surrounded by a rotor tank, which is also located inside the centrifuge housing. The underside of the rotor tank has a passage for the drive shaft. The centrifuge housing can be closed towards the top. The motor is held between an upper end shield and a lower end shield.

The known centrifuge consists of a multitude of different parts, so that its assembly is relatively expensive. Furthermore, the known centrifuge requires expensive measures to cool it.

SUMMARY AND OBJECTS OF THE INVENTION

It is an object of the present invention to provide a laboratory centrifuge whose manufacture is economical, which is easy to assemble, and which can be easily cooled, if necessary.

These and other objects and advantages of the invention will be better understood by reference to the detailed description, or will be appreciated by the practice of the invention.

To achieve the foregoing objects, and in accordance with the invention as embodied and broadly described herein, starting from the laboratory centrifuge as described above in the background section, the rotor tank and the upper end shield of the motor housing are made as a single piece. Making the rotor tank and the upper end shield as a single piece does away with both a portion of the manufacturing costs for the laboratory centrifuge and a portion of the assembly expense because the upper end shield simultaneously forms the rotor tank. This allows the laboratory centrifuge to be made compact and easy to cool. Thus, the rotor tank is understood to mean the housing surrounding the rotor, however, without covers, lids, etc.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof illustrated in the appended drawing. Understanding that the drawing depicts only typical embodiment of the invention and is not therefore to be considered limiting of its scope, the invention will be described and explained with additional specificity and detail through the use of the accompanying drawing in which:

The sole Figure is a schematic representation of a preferred embodiment of a laboratory centrifuge according to the invention in the form of a table centrifuge.

DETAILED DESCRIPTION OF THE PREFERRED EMBODIMENTS

One implementation of the laboratory centrifuge according to the invention has proved itself especially worthwhile, in which the rotor tank and the upper end shield for the motor consist of a single cast part. Examples of possible materials for the cast part are chemical-resistant and shock-resistant plastics or aluminum. The cast part can be manufactured simply and economically using the pressure die-casting process, for example.

One implementation has proved itself especially worthwhile, in which the upper end shield and the rotor tank also form at least a portion of the centrifuge housing. Since the upper end shield and rotor tank are made as a single piece, the cooling of the centrifuge housing from outside is especially simple to manage.

One laboratory centrifuge has proved itself especially worthwhile, in which the upper end shield formed as a single piece with the rotor tank and the lower end shield for the motor also form at least a portion of the centrifuge housing. This portion can be made visually attractive such that a separate casing or covering is not needed. The top part of the centrifuge housing (integral with the single piece rotor tank/upper end shield) and the lower part of the centrifuge housing (integral with the lower end shield) are tightly connected with one another by a clamping device. Apart from a small crack at the junction of the clamped-together parts, the top part and the lower part close flush with one another and, thus, form a substantially common front surface to the centrifuge housing. In this embodiment, the centrifuge housing, the end shields for the motor, and the rotor tank can be made from a total of two components. This embodiment of the laboratory centrifuge is also compact and especially easy to cool from outside.

It is advantageous if a bearing for the drive shaft is arranged in the passage formed through the rotor tank for the vertically-oriented drive shaft. This allows the centrifuge to be made especially compact.

One laboratory centrifuge has proved itself especially worthwhile, in which cooling elements are arranged on the outside wall of the centrifuge housing, in the area of the rotor tank. The cooling elements can be in the form of cooling fins on the back side of the laboratory centrifuge housing, opposite the front surface, for example. The cooling elements are especially effective, since they are directly connected with the single piece forming both the rotor tank and the upper end shield of the motor.

With regard to keeping the expense for assembling the laboratory centrifuge as low as possible, embodiments have proved especially advantageous in which a cover hinge and/or a locking element is integrally molded on the rotor tank.

A preferred embodiment of the laboratory centrifuge has the single piece forming the rotor tank and upper end shield for the motor and the second piece forming lower end shield for the motor forming a substantially common front surface of the centrifuge housing, as described above, and is further provided with a control box for operational and control elements. The common front surface is preferably made on the front side of the centrifuge housing permitting the control box to extend, if desired, over the entire height and width of this front surface.

It has proved especially worthwhile to provide the lower end shield with feet for stably supporting the centrifuge. It is advantageous if the feet are made in a single piece with the lower end shield. This reduces the assembly expense. This embodiment of the laboratory centrifuge is especially suitable for use as a table centrifuge.

A preferred embodiment of the laboratory centrifuge according to the invention will be explained in detail below with reference to FIG. 1, a schematic representation of a laboratory centrifuge according to the invention in the form of a table centrifuge.

The table centrifuge has a centrifuge housing which, as a whole, is assigned the reference number 1. The centrifuge housing consists of a top part 2 and a lower part 3. Top part 2 and lower part 3 are preferably both pressure die-cast aluminum parts. The top part 2 forms both the rotor tank 4 and the upper end shield 5 for the motor 6.

The lower part 3 of the centrifuge housing 1 forms the lower end shield for the motor 6. The motor 6 is connected on the upper end with the drive shaft 7, which in turn is connected with the rotor 8. For this purpose, the free end of drive shaft 7 projects through a passage formed through the bottom of the rotor tank 4, into which a bearing 9 is simultaneously put to guide the drive shaft 7 drive shaft 7 also has a lower end 26 that is rotatably attached to lower part 3 by a bearing 28.

Top part 2 and lower part 3 bound a motor chamber 24 therebetween. Motor 6 is disposed within motor chamber 24. Motor 6 comprises a motor stator 20 disposed in stationary abutting contact with top part 2 and lower part 3. Top 2 and lower part 3 function as the sole housing for motor stator 20. Motor 6 further includes a motor rotor 22 attached to drive shaft 7 and rotatably disposed within motor stator 20.

The rotor tank 4 can be closed with a foldable cover 10. To hold the cover 10, the area of the top side of the rotor tank 4 is provided with cover hinges 11, which are an integral part of the rotor tank 4. Furthermore, the area of the top side of the rotor tank 4 has an integrally molded locking element 12 to hold the cover 10 tight.

The top part 2 and the lower part 3 of the centrifuge housing 1 are tightly connected with one another by a clamping device 13. Apart from a small crack 14, the top part 2 and the lower part 3 close flush with one another and thereby form a common front surface 15, on which a control box 16 is placed. The control box contains the operational, functional, and control elements for the table centrifuge.

Holders for suction feet 17 are preferably integrally molded on the underside of the lower part 3.

The fact that the top part 2 simultaneously serves as rotor tank 4 and as the upper end shield 5 for the motor 6 makes possible an especially compact construction of the table centrifuge. The cooling of the table centrifuge is especially effective. The sample implementation is cooled by the cooling fins 18 which on the back side 19, that is on the side opposite the front surface 15.

As explained above, the centrifuge housing 1 in the table centrifuge according to the invention is made from very few components and also comprises the upper end shield for the motor, the rotor tank, and the lower end shield for the motor. Therefore, the assembly of the table centrifuge is especially simple. The individual parts of the centrifuge housing 1 can be manufactured using injection molding or pressure die-casting. Many functional elements, such as, for example, even the cover hinge 11, the locking element 12, parts of the clamping device 13, or even the attachment elements for the suction feet 17 can be provided as integral components of the injection molded or pressure die-cast part. This further simplifies the assembly.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is desired to be secured by United States Letters Patent is:

It is claimed:

1. A laboratory centrifuge comprising:

(a) an upper housing portion having a rotor chamber formed therein;

(b) a lower housing portion attached to the upper housing portion, the upper housing portion and lower housing portion bounding a motor chamber therebetween;

(c) a drive shaft extending between rotor chamber and the motor chamber;

(d) a centrifuge rotor being disposed within the rotor chamber and coupled with the drive shaft; and (e) a motor rotor and motor stator being positioned within the motor chamber, the motor rotor being coupled with the drive shaft, the motor stator being in abutting contact with the upper and lower housing portions, the motor rotor and motor stator being within the motor chamber such that the upper housing portion and lower housing portion function as the sole housing for the motor rotor and motor stator.

2. A laboratory centrifuge as recited in claim 1, wherein the drive shaft has a lower end rotatably attached to the lower housing portion.

3. A laboratory centrifuge as recited in claim 1, wherein the upper housing portion is a unitary cast metal element.

4. A laboratory centrifuge as recited in claim 1, further comprising cooling fins positioned on the upper housing portion.

5. A laboratory centrifuge as recited in claim 1, further comprising a cover hingedly attached to the upper housing portion.

6. A laboratory centrifuge as recited in claim 1, further comprising means for securing the upper housing to the lower housing portion.

7. A laboratory centrifuge as recited in claim 1, wherein the upper housing portion and the lower housing portion form a common front face having a control box mounted thereon.

8. A laboratory centrifuge as recited in claim 1, wherein the lower housing portion has feet mounted thereon.

9. A laboratory centrifuge comprising:

(a) an upper housing portion having a rotor chamber formed therein;

(b) a lower housing portion removably attached to the upper housing portion;

(c) a drive shaft having a lower end rotatably attached to the lower housing portion and an upper end extending through the upper housing into the rotor chamber;

(d) a centrifuge rotor being disposed within the rotor chamber and coupled with the upper end of the drive shaft;

(e) a motor stator being disposed between and in abutting contact with the upper housing portion and the lower housing portion such that the upper housing portion and lower housing portion function as the sole housing for the motor stator; and (f) a motor rotor mounted to the drive shaft and disposed within the motor stator.

10. A laboratory centrifuge as recited in claim 9, further comprising a cover and a hinge, the hinge being at least partially integrally formed on the upper housing portion, the hinge coupling the cover to the upper housing portion.

11. A laboratory centrifuge as recited in claim 9, wherein the upper housing portion and the lower housing portion are each cast from a material comprising aluminum.

12. A laboratory centrifuge as recited in claim 9, further comprising cooling fins positioned on the upper housing portion.

13. A laboratory centrifuge as recited in claim 9, further comprising a clamp securing the upper housing portion to the lower housing portion.

14. A laboratory centrifuge as recited in claim 9, wherein the upper housing portion and the lower housing portion form a common front face having a control box mounted thereon.

15. A laboratory centrifuge as recited in claim 9, wherein the lower housing portion has feet mounted thereon.

* * * * *